United States Patent [19]

Boswell

[11] 4,395,042

[45] Jul. 26, 1983

[54] GAME APPARATUS

[76] Inventor: James W. Boswell, 2401 Rockmart Hwy., Apt. 7A, Rome, Ga. 30161

[21] Appl. No.: 356,776

[22] Filed: Mar. 10, 1982

[51] Int. Cl.[3] ..... A63B 69/36

[52] U.S. Cl. ..... 273/176 B; 273/181 F; 273/181 A

[58] Field of Search ..... 273/181 F, 184 R, 185 R, 273/181 A, 181 E, 181 C, 181 G, 181 H, 181 J, 181 K, 182 R, 182 A, 398, 400, 401, 176 B, 176 A, 180

[56] References Cited

U.S. PATENT DOCUMENTS

| | | | |
|---|---|---|---|
| 507,098 | 10/1893 | Bates | 273/401 |
| 1,166,496 | 1/1916 | Torrey | 273/181 F |
| 1,469,130 | 9/1923 | Whitehair | 273/176 B |
| 1,527,988 | 3/1925 | McMurtrie | 273/181 F X |
| 1,719,240 | 7/1929 | Scanlan | 273/176 B |
| 2,450,125 | 9/1948 | Dunfee | 273/181 F X |
| 3,594,006 | 7/1971 | Clatt | 273/185 R X |

FOREIGN PATENT DOCUMENTS

| | | | |
|---|---|---|---|
| 662904 | 5/1963 | Canada | 273/181 F |

*Primary Examiner*—George J. Marlo

[57] ABSTRACT

A game apparatus and eighteen hole golf course having a structure which supports three separate gaming levels facing a player for use in competitive entertainment and for developing the player's chipping and pitching golf stroke wherein the player or participants stand in front of the apparatus, places the ball on a hitting surface, and properly strokes the ball to propel the ball on an arch so that it might penetrate a selected and numbered initial aperture in a flexible target means on any of the selected gaming levels and, if possible, to subsequently penetrate a second aligned and more inacessible aperture and to lodge in its catching net attached to the holding board that retains the catching net. The location of the ball after each stroke will determine the player's score for each hole and indicate skill level, which score can then be tallied on the eighteen hole scorecard detailing rules of play.

10 Claims, 3 Drawing Figures

FIG. 1
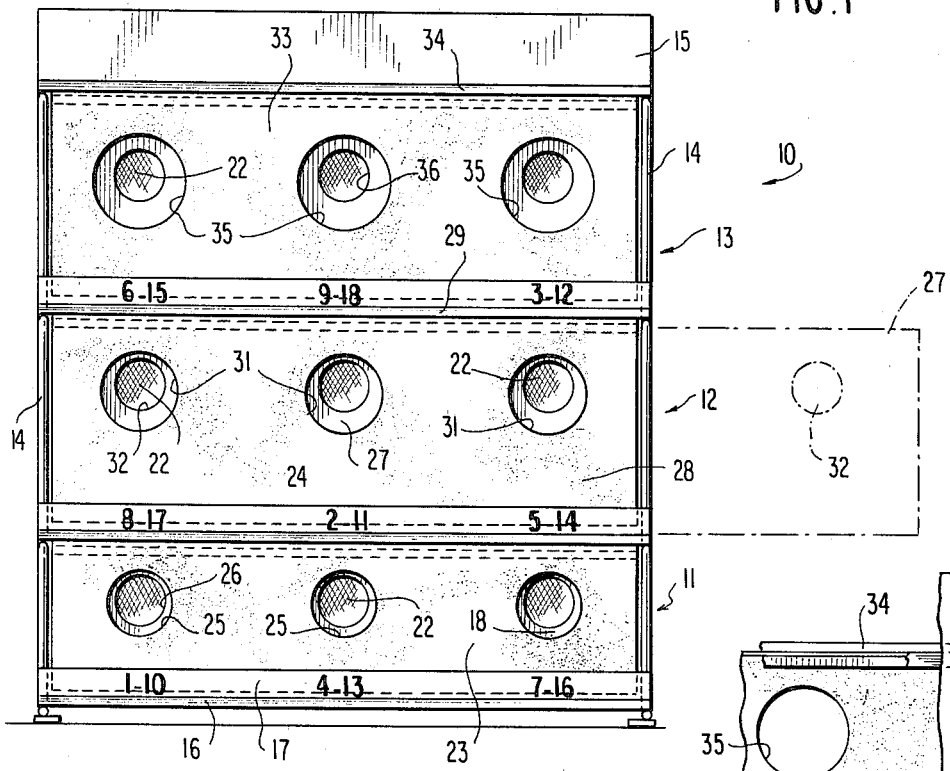
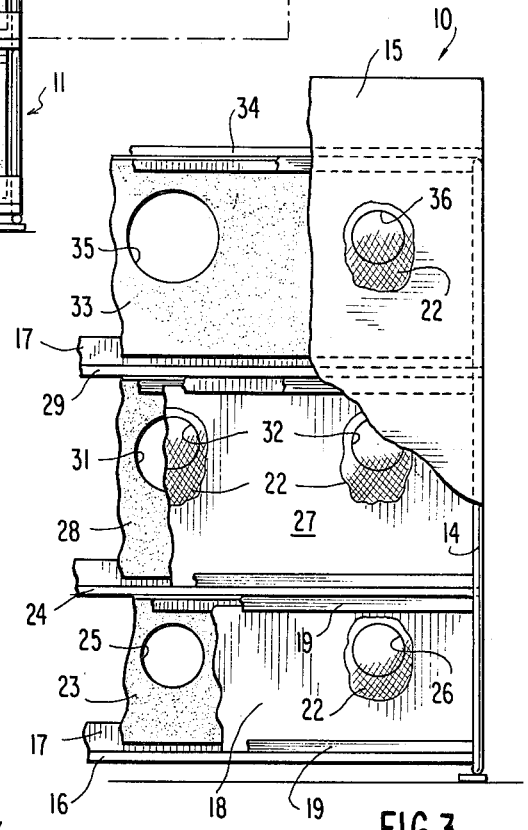
FIG. 3
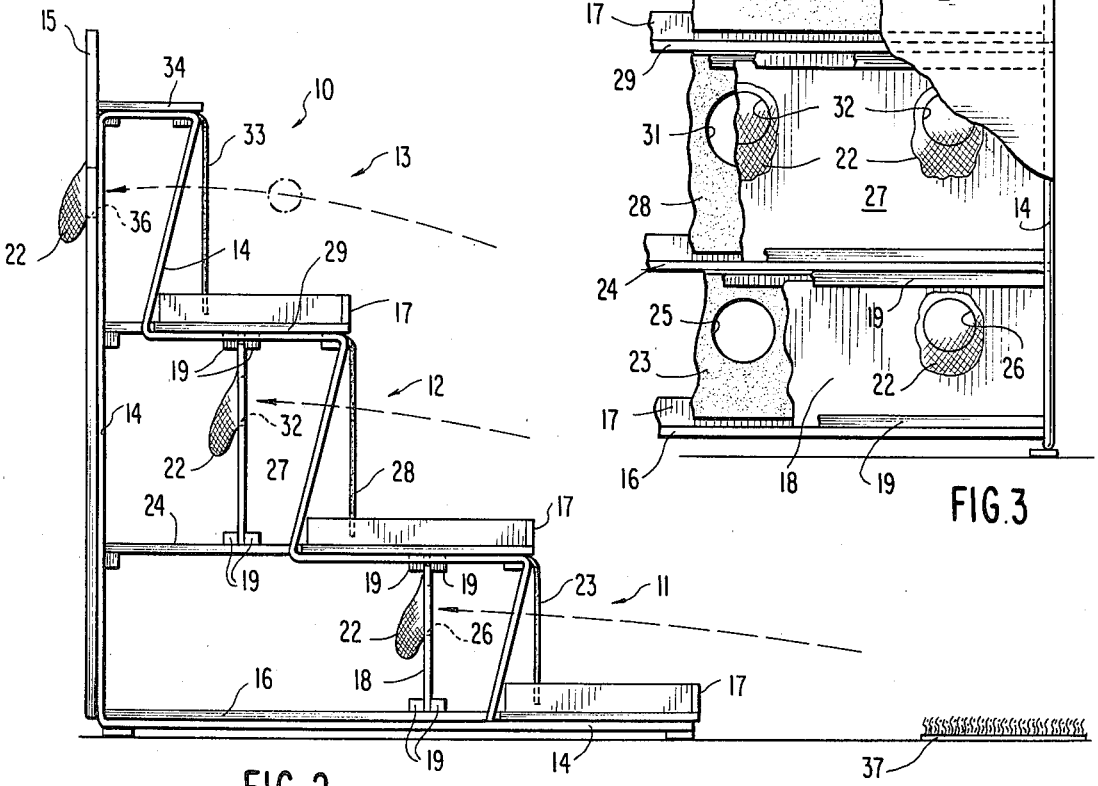
FIG. 2

GAME APPARATUS

BACKGROUND OF THE INVENTION

It has long been recognized that the key to any game involving athletic ability is practice by the person wishing to become skilled in that game. In the game of golf, this is especially true because of the many variables involved and the necessity of the player to develop very definite skills in several different major areas of the game. In order to practice the game of golf, especially if one is to develop a proper swing for a stroke which is to be utilized on the golf course, the person wishing to practice normally has to practice out of doors at a driving range or at some other suitable location entailing a large area which is necessary for the practice. There are a number of games which can be practiced indoors pertaining to golf, but these are normally limited to the development of the putting stroke.

Practice facilities are also known utilizing the so-called full strokes in which a player hits the ball into a large net so that the full stroke can be practiced. However, in such an instance, only the actual stroke is practiced, and the results of that practice cannot be easily determined because there is no down range scoring mechanism to indicate the results of a proper or improper swing. There have been devised some rather elaborate practice devices which attempt to simulate the game by projecting upon a screen, golf course holes from tee to green to which a person practicing drives the ball from a mat and then the results of the drive are registered electronically by reading several variables involved to simulate an outdoor golf course.

As can be seen, all of the prior art games have certain limitations in that they either do not simulate the total game or game segments properly or that the expanse necessary is out of the reach of the player desiring to practice at home.

Accordingly, it is a general object of the present invention to provide an improved game for the practice of an important segment of golf.

More specifically, it is an object of the present invention to provide a game by which a player may practice the game of golf in an indoors or outdoors environment of limited space and at reasonable cost.

Another object of the invention is to provide a game which may be played by one or more players simulating an eighteen hole golf course which also allows a player to develop competitively the all important chipping and pitching golf stroke.

Yet another object of the invention is to provide a game in the form of educational, teaching and learning facilities for the game of golf to help a player develop highly competent up and down skills that are transferrable to the player's regular golf game.

SUMMARY OF THE INVENTION

In the preferred form of the invention shown herein, a game apparatus is shown having a suitable supporting structure to which a player practicing the game of golf will shoot a regulation golf ball in the normal manner. The game apparatus generally has three levels, one atop the other in height with each level having three apertures facing the player who is standing a few feet in front of the game apparatus wherein each hole represents an actual hole on a golf course and is so numbered. Each level of the game is divided into three scoring sections. The first scoring section is the area immediately in front of the apertures located on that level and can be considered the "green" level. The various apertures are then cut into a resilient matting material which is vertical to the green surface. Located somewhat behind the matting material is a removable panel in which another set of three apertures for each level are provided behind which there is affixed a net for catching the balls. In the preferred embodiment, the apertures which are in the resilient matting material are relatively large, but each set of holes on each level are somewhat changed in diameter to provide different degrees of difficulty to the player. For instance, the apertures in the lower most level are smaller than the apertures in the second level, which are yet smaller than the apertures in the third level. The rear most holes to which the ball catching nets are attached may all be of the same diameter, yet, this is not an absolute requirement.

The objective of the game is to stroke a regulation golf ball toward the hole being played with the least number of strokes. The final resting place of the ball after it has been stroked determines the score. Obviously, the player who strokes the best pitch and chip shots will have the lowest score. The area of play will be from a point in front of the game apparatus and, if the apparatus is to be used indoors, it will be desired to have a playing mat placed at the point of striking the ball. Normally, the playing mat will have areas which are indicated as "tee areas" for the particular hole being played. As the game is more fully described during the description of the preferred embodiment the scoring of the game will become apparent and will be easily understood.

Other objects, advantages and capabilities of the invention will become apparent from the following description, taken in conjunction with the accompanying drawings, showing only a preferred embodiment of the invention.

BRIEF DESCRIPTION OF THE DRAWINGS

FIG. 1 is a vertical view of the invention with a portion of the invention shown in phantom lines indicating the method of removing the ball catching net holding boards.

FIG. 2 is a side elevation view of the invention showing an open side and indicating a normal flight path of the ball after being hit which is required to bring the stroked ball into the ball catching net for the best possible score.

FIG. 3 is a fragmentary rear view of the game apparatus with certain parts broken away for clarity of description.

DETAILED DESCRIPTION OF THE PREFERRED EMBODIMENT

Referring now to the drawings wherein like numerals designate corresponding parts throughout the several figures, FIG. 1 illustrates the invention in a vertical elevation view. The game apparatus of the present invention as shown in FIG. 1 is indicated generally by the numeral 10. As can be readily observed in all of the Figures and especially in FIG. 2, the game apparatus generally comprises three different distinct levels generally indicated by the numerals 11, 12 and 13. Each distinct game level will, as later described herein, constitute a degree of difficulty as opposed to the other game levels.

In actual manufacture, the game apparatus may be made of various materials suitable to the conditions to which they will be put and suitable to various degrees of quality which the game manufacturer may desire at any particular time. Therefore, the description of the game apparatus herein should not be taken in a limiting fashion, but it is given only for illustrative purposes. The main frame for the apparatus is a pair of side rails, one on each side, indicated by the numeral 14 and as is apparent, the side rail is of unitary construction which may readily be solid or hollow metal tubing bent and/or welded into the desired configuration. The side rails provide the complete support for the other connecting portions of the apparatus and provide a very strong unitary structure. It is contemplated that the game may be manufactured in a knocked-down, unassembled configuration to be reassembled by the ultimate purchaser and, consequently, the parts herein should be designed with that in mind.

Connecting the side rails 14 to one another is a backboard 15 which connects to the side rails 14 by suitable fasteners (not shown) and which extends across the back of the game apparatus encompassing both of the side rails at the rear portion thereof.

Each of the various levels 11, 12 and 13 have similar construction with certain dissimilarities as will be described. As can be readily seen from the drawings and especially FIG. 2, the construction of the lower level 11 comprises a floor board 16 which extends the full length of the level from the backboard 15 to the front of the apparatus as it faces the player. The floorboard is designed to be solid so that it catches all of the balls which may be hit to the game apparatus and to provide additional rigidity to the apparatus. Attached to the floorboard 16 is a rim 17 which is fitted around a portion of the periphery of the floorboard 16 which faces toward the player. The rim 17 should be of a suitable height to maintain the golf balls within the confines of the floorboard of the lower level 11 once they impact therein. In between the lower level 11 and the middle level 12, there is set a net board 18 so that it is vertically disposed between the two levels 11 and 12. The net board is slid between guide members 19, attached to the floorboard 16 of the lower level and preferably, the floorboard 21 of the middle level. As will be readily appreciated, the net board is then capable of being removed from the game apparatus quite easily as desired. This is especially necessary when the player drives a golf ball properly into the catching net 22 that is attached to the net board 18. The method of removing the net board is shown by the phantom lines in FIG. 1, in relation to the net board 27 of the middle level 12.

The catching net 22 can obviously be made of any suitable material and should be sufficiently pliable and of such a size as to be able to catch a golf ball which is hit into it and to maintain the ball in the net so that it does not bounce back onto the floorboard 16 of the lower level. An important aspect of the game is the manner in which the golfer scores himself for the shots made. To accomplish this goal, a piece of flexible material 23 is affixed to the underside of the middle level floorboard 24 and is so designed as to be somewhat narrower in width than the side rails 14 and is so affixed that it hangs downwardly just short of the lower level floorboard 16. In this manner, the material is flexible and will swing slightly when a ball impacts with it. It is anticipated that the material can be of any suitable type, either cloth, rubber, or some similar flexible type of material having rebound qualities which would include it being capable of withstanding hits by golf balls and to take a certain amount of punishment and yet be flexible enough to absorb some impact and move freely backward to help absorb the impact of the ball. Obviously, the weight of the material would be an important consideration in these qualities as well as its flexibility.

In the flexible material 23 which, for convenience sake, herein shall be called a riser, there are placed substantially equally distanced from one another three holes 25 which are sized by the manufacturer to allow the passage of a golf ball therethrough. Obviously, the holes are to be larger than the golf ball itself. The size of the holes 25 are designed to increase the difficulty of the particular golf shot being made as will be explained later on. The other levels 12 and 13 also have similar construction and it is desired in the embodiment described that the holes in the risers be of increasing size for each of the levels so that, in effect, the holes on the risers of the upper level 13 will be the largest and this, of course, would make the golf shot the easiest at that level while the golf shot for the lower level 11 would be the hardest if the upward trajectory required is not considered. However, upward trajectory adds difficulty to upper level shots.

As was previously described, located to the rear of the riser 23 is the net board 18 which includes a plurality of catching nets 22. In order for the nets to be utilized, the net board 18 is designed to have a plurality of holes 26 so located that they are directly behind holes 25 in the riser 23. However, when looking at the front of the game apparatus as portrayed in FIG. 1, it is obvious that the holes 26 in the net board are not concentrically located with the holes 25 in the riser. The reason for this is that during the play of the game, the ball will be hit on the rise and the parabola curve involved necessitates that the holes 26 in the net board be offset in relation to the holes 25 to a slight degree in an upward direction. Therefore, the net 22 is attached to the net board 18 so as to cover the holes 26 to allow a ball which is hit through holes 25 and through holes 26 to be caught by the catching net 22 and retained therein.

Now referring to the middle level 12, it is seen that this level is substantially similar to the lower level 11 in its construction wherein the net board 27 is placed between guides 19 in a perpendicular fashion to the rear of the flexible riser 28. The riser for the middle level is connected in the same manner as that shown for the lower level to the lower surface of the upper level floorboard 29 and depends therefrom in a free swing relationship as previously described. Within the riser 28, there are three holes 31 so placed as to be similar to the holes 25 of the riser of the lower level. Within the net board 27, there are also three corresponding holes 32 similar to the holes 26 as previously described for the lower level. Attached to the net board 27 surrounding the rear of the holes 32 is a similar catching net 22 as previously described which is used for the same purpose. Around the periphery of the front part of the floorboard 24, there is a rim 17 similar to the one previously described for the lower level and utilized for the same purpose.

Similarly, the upper level 13 includes a depending riser 33 of the same flexible material as previously described. This riser is attached to a riser attaching member 34 which projects outwardly from the backboard 15. Of course, riser 33 also has three holes therein identified by the numeral 35 spaced equally distanced apart.

And in the same manner as previously discussed, the upper level floorboard 29 has around its forward periphery the rim 17 utilized to collect golf balls falling upon the floorboard. Behind the riser 33, the catching net 22 is attached to the backboard 15 and is located around the upper level net holes 36.

While the description of the preferred embodiment may take many forms, the sizes of the various apertures in the risers and in the net board may be varied to suit a certain degree of skill level, it is anticipated that certain sizes of these apertures will be found to be of optimum size. For instance, the holes in the net boards are anticipated to be of a two inch diameter while the holes in the risers should be an eight inch diameter for the upper level 13, a seven inch diameter for the middle level 12 and a six inch diameter for the lower level 11. Obviously then, it can be seen that the placement of the ball in the holes of the upper level, if upward trajectory is not considered, should be the easiest for the person playing the game, yet the placement of the ball in the net of each level once the ball has passed through the front riser, is of equal difficulty. The required upward trajectory will increase difficulty. Obviously, the placement of the ball through the riser holes 25 of the lower level 11 is the least difficult and correspondingly, the holes in the middle level fall between the lower and upper level in difficulty.

To play the game, a golfer would place his ball upon a hitting mat 37 located some three or four feet in front of the game apparatus. The hitting mat would preferably be designed with the golfing tee location placed upon the mat to correspond with the holes on the game apparatus itself. Therefore, a golfer would place his ball upon the area of the hitting mat corresponding to the hole to which he is playing and would stroke the ball correctly to that particular hole in the game apparatus. A ball that hits the riser and does not penetrate the hole in the riser itself and comes to rest upon the floorboard "green" of the level corresponding to the hole being shot and retained within the rim 17 would be scored as a "par 3". A ball that enters the riser hole of the hole being played and comes to rest behind the riser without penetrating the hole in the net board would be scored as a "birdie 2", and, correspondingly, a ball that comes to rest in the catching net 22 after passing through the riser hole and the net board hole would be scored as a "hole in one". A ball that would come to rest on any outside "green" and in front of a riser mat which is other than the green of the hole being played, then that ball would be scored as a "bogey 4". If, after hitting the ball and the ball should rebound off of the game apparatus all together, the score would then be "double bogey 5" and should a player stroke a ball and completely miss the game apparatus all together, the ball would be counted as "out of bounds" requiring a stroke and distance penalty to be imposed. Likewise, a ball that would enter a riser mat hole which is not the hole being played and comes to rest behind the rubber mat would also be a "double bogey 5", and should a ball come to rest in the catching net of a hole net being played, then the player would be assessed a "triple bogey 6". As can be seen from the above description of the preferred embodiment, the game allows a player to practice the chipping and pitching strokes of the golf game which is considered the all important aspect of the game. A player who develops his skills on the game of this invention will be quite competent in the up and down skills of golf and will find that these skills will be transferrable to the regular golf game.

To help in scoring, it may be found necessary to separate the holes from one another by means of dividers placed behind the risers 23, 28 and 33 to determine which hole the ball actually went through.

It hould be understood that the just described embodiment merely illustrates principles of the invention and selected preferred form. Many additions, deletions and other modifications may, of course, be made thereto without departing from the spirit and scope of the invention as set forth in the following claims.

What is claimed is:

1. A game apparatus of diminutive size used to improve a player's golf stroke in which a golf ball is hit to the game apparatus from a location spaced from the game apparatus, comprising an upright structural framework having a front, back and two sides, said framework having a plurality of levels one atop the other, each level having a floor to separate it from the adjacent levels, the floor extending from the front to the rear of the game apparatus, each level having a vertically disposed flexible means spaced rearwardly from the front edge of the floor, a plurality of apertures within the flexible means, board means located rearwardly of the flexible means in conjunction with each level to which there is attached on the rearwardly side thereof a net means, said board means including a plurality of apertures juxtaposed with the net means to thereby provide a passage through the board means into the net means, whereby the player's properly stoked golf ball penetrates a selected aperture of the flexible means and a selected aligned aperture in the board means to lodge in the net means.

2. The game apparatus of claim 1, wherein the levels comprise a lower, middle and an upper level, each with upstanding rim means around a portion of the periphery of the floor to retain golf balls hit onto the floor, said flexible means being hung for free swinging movement facing the player, said flexible means defining a target area to the player.

3. The game apparatus of claim 2, wherein each target area has a plurality of apertures spaced apart in the flexible means, nine in total, each of which has two of the numbers from one to eighteen, none duplicated.

4. The game apparatus in claim 3, wherein the apertures in the flexible means having varying diameters.

5. The game apparatus of claim 4, wherein all of said apertures on each individual lower, middle and upper level are of the same diameter.

6. The game apparatus of claim 5, wherein said apertures differ in diameter between the various levels.

7. The game apparatus of claim 6, wherein said board means being selectively removable from said game apparatus to enable the player access to said net means.

8. The game apparatus of claim 7, wherein said board means apertures are so spaced in said board means so as to be aligned with the apertures of the flexible means.

9. The game apparatus of claim 8, wherein said board means apertures are of the same size.

10. A game apparatus and instructional device used to improve a player's golf stroke in which a golf ball is hit to the game apparatus from a location spaced from the game apparatus, comprising an upright structural framework having a front, back and two sides, said framework having a plurality of levels, one atop the other, wherein the levels comprise a lower, middle and an upper level, each level having a floor to separate it from the adjacent levels, the floor extending from the front to the rear of the game apparatus, upstanding rim means around a portion of the periphery of the floor to retain golf balls hit onto the floor, each level having a vertically disposed flexible means spaced rearwardly from the front edge of the floor, said flexible means being hung for free swinging movement facing the player, said flexible means defining a target area to the player wherein the target area is provided with a plurality of apertures spaced apart in the flexible means, the apertures in the flexible means having varying diameters, board means located rearwardly of the flexible means in conjunction with each level to which there is attached on the rearwardly side thereof a net means, said board means including a plurality of apertures juxtaposed with the net means to thereby provide a passage through the board means into the net means, said board means being selectively removable from said game apparatus to enable the player access to said net means, said board means apertures being so spaced in said board means so as to be aligned with the apertures of the flexible means, the apertures of said board means being of the same diameter, whereby the player's properly stroked golf ball penetrates a selected aperture of the flexible means and a selected aligned aperture in the board means to lodge in the net means.

* * * * *